US005893412A

United States Patent [19]

Nishishita et al.

[11] Patent Number: 5,893,412

[45] Date of Patent: Apr. 13, 1999

[54] LAMINATED HEAT EXCHANGER

[75] Inventors: Kunihiko Nishishita; Seiji Inoue, both of Konan; Fumio Ohkubo, Higashimatsuyama, all of Japan

[73] Assignee: Zexel Corporation, Tokyo, Japan

[21] Appl. No.: 09/046,639

[22] Filed: Mar. 24, 1998

[30] Foreign Application Priority Data

Mar. 31, 1997 [JP] Japan ..... 9-098249

[51] Int. Cl.[6] ..... F28D 1/03

[52] U.S. Cl. ..... 165/153; 165/176; 165/DIG. 465; 165/DIG. 466; 228/183

[58] Field of Search ..... 165/153, 176, 165/DIG. 465, DIG. 466; 228/183

[56] References Cited

U.S. PATENT DOCUMENTS

| | | | |
|---|---|---|---|
| 5,553,664 | 9/1996 | Nishishita et al. | 165/153 |
| 5,617,914 | 4/1997 | Kinugasa et al. | 165/153 |
| 5,649,592 | 7/1997 | Nishishita | 165/153 |

FOREIGN PATENT DOCUMENTS

| | | | |
|---|---|---|---|
| 625686 | 11/1994 | European Pat. Off. | 165/174 |

*Primary Examiner*—Allen Flanigan

*Attorney, Agent, or Firm*—Wenderoth, Lind & Ponack, L.L.P.

[57] ABSTRACT

In order to prevent a communicating pipe from becoming damaged by water (in particular drain water) collecting in the gap formed between the tube element at one end of a heat exchanger that is constituted of a flat plate and a formed plate and the communicating pipe through defective brazing and repeatedly freezing and melting, a flange (32) and a bonding margin (11) continuous to the flange (32) are notched off over almost the entire circumference at the center on the inside of an indented portion (9) in a formed plate (16) which, together with a flat plate (15), constitutes a tube element (3*b*). Thus, while the communicating pipe (27) comes in contact with the internal surface of a flange (29) of a pipe connection hole (28) of the flat plate (15), it does not come in contact with the formed plate (16), thereby forming a gap bounded by the flat plate (15), the formed plate (16) and the communicating pipe (27).

12 Claims, 7 Drawing Sheets

LAMINATED HEAT EXCHANGER

BACKGROUND OF THE INVENTION

The present invention relates to a laminated heat exchanger that may be employed in an evaporator or the like constituting the refrigeration cycle in an air conditioning system for vehicles, for instance, having an inflow port and an outflow port provided side-by-side at one side in the direction of the lamination.

The invention completed by the applicant of the present invention, which is disclosed in Japanese Unexamined Patent Publication No. H8-121988, achieves the prevention of freezing damage or corrosion of the tube elements or the communicating pipe which may occur in a laminated heat exchanger constituted by laminating tube elements each having a pair of tanks at one side and a groove portion formed between the tanks alternately with fins over a plurality of levels so that a communicating passage extends between the tanks in the direction of the lamination with the communicating pipe mounted at the communicating passage, when water is collected in the gap formed through defective brazing of the communicating pipe and the circumferential edges of the groove portions constituting the communicating passage. This invention is already in use.

According to this invention, each of the tube elements is provided with a pair of tanks and a U-shaped heat exchanging medium passage communicating between the pair of tanks and is constituted by bonding face-to-face a pair of formed plates. In one of the formed plates in the pair, a flange that is bent toward the non-bonding side is formed in order to increase the strength of the formed plate over the entire circumference at the edge portion of the brazing margin at the circumferential edges of the distended portion for passage formation and the distended portion for tank formation, whereas in the other formed plate, this flange and a brazing margin continuous to the flange are notched over the entire circumferential edge of the groove portion between the tanks. With this, in tube elements constituted by bonding these formed plates, only the groove portion at one of the formed plates comes in contact with the communicating pipe. Alternatively, one side relative to the center of the circumferential edge of the groove portion in each formed plate may be notched, and in tube elements constituted by bonding such formed plates, the communicating pipe comes in contact with alternate groove portions.

As a result, since a large opening is formed between the communicating pipe and the groove portions of the tube elements having the width over which the center of the circumferential edge of the groove portion at the formed plate is notched toward the front end of the formed plate or having the width over which one side relative to the center of the inside circumferential edge of groove portion of the formed plate notched toward the front end of the formed plate, drainage is improved to prevent water from collecting, so that a problem of collected water repeatedly freezing and melting to damage the tube element and the communicating pipe is eliminated. In addition, the problem of the tube element and the communicating pipe becoming corroded by the collected water, is avoided.

Now, laminated heat exchangers employing a communicating pipe include the type illustrated in FIGS. 12 and 13, in which a formed plate 100 and a flat plate 101 are bonded to each other at one side in the direction of the lamination, a distribution plate 102 is further bonded to the flat plate 101 to form an inflow passage 103 and an outflow passage 104 and one end of a communicating pipe 106 is inserted and fitted in a hole 105 formed in the flat plate 101 to allow a heat exchanging medium to flow in to a specific tank through the inflow passage 103. In this heat exchanger, in order to perform brazing of the flat plate 101 and the communicating pipe 106 in a reliable manner, a flange 107 is formed at the circumferential edge of the hole 105 of the flat plate 101 extending toward the non-bonding side that is not bonded to the formed plate 100.

If the formed plate 100, which is bonded to the flat plate 101 in the laminated heat exchanger, is structured identically to a formed plate in the prior art described earlier, since a bonding margin 109 that contains a flange 110 of the formed plate 100 is bonded to a portion of the flat plate 101 which is in close proximity to the flange 107 at one end of the groove portion 108, there are potential problems that may occur in the event of defective brazing, in that a triangular gap A which is not filled with the brazing material is formed between the formed plate 100, the flat plate 101 and the communicating pipe 106 as illustrated in FIG. 14. This results in water such as the drain water collecting in the gap A and, through a process of repeated freezing and melting, damaging the tube element 111 constituted of the formed plate 100 and the flat plate 101 or the communicating pipe 106, and in the collected water corroding the tube element 111 or the communicating pipe 106.

SUMMARY OF THE INVENTION

Accordingly, an object of the present invention is to provide a laminated heat exchanger provided with a tube element constituted of a formed plate and a flat plate at one end of the direction of the lamination of the tube elements each constituted by bonding two formed plates and fins, in which water is not allowed to readily collect between the tube element constituted of the formed plate and the flat plate and the communicating pipe.

Thus, in the laminated heat exchanger according to the present invention, which is constituted by alternately laminating over a plurality of levels tube elements each constituted by bonding face-to-face two formed plates at their bonding margins, a pair of tanks at one side with an indented portion provided therebetween and a heat exchanging medium passage communicating between the tanks, and fins, by providing a tube element constituted of a formed plate which is formed to have a basically similar shape as the formed plates constituting the other tube elements, and a flat plate with a pipe connection holes formed therein and by providing a communicating pipe in the indented portions between the tanks so that with the communicating pipe connected to a specific tank, a flow path for a heat exchanging medium is formed with an inflow port and an outflow port provided side-by-side at one side in the direction of the lamination, an area near one side of the communicating pipe is not in contact with the indented portion of the formed plate in the tube element constituted of the flat plate and the formed plate.

In addition, in order to ensure that the communicating pipe does not come in contact with the formed plate even when it is inserted and fitted in the pipe connection hole of the flat plate, a bonding margin having a flange may be formed at the circumferential edge of the formed plate in the tube element constituted of the flat plate and the formed plate at the inflow outflow port side, with the flange and the bonding margin continuous to the flange notched off at the indented portion between the tanks.

Alternatively, the diameter of the communicating pipe in the area near the end that is connected to the pipe connection hole of the flat plate may be set smaller than the diameter of the indented portion of the formed plate which is bonded to the flat plate that is to form an inflow passage and an outflow passage.

Consequently, since, while the area near the end of the communicating pipe at one side is inserted and fitted in the pipe connection hole of the flat plate, the flange and the bonding margin continuous to the flange are notched at the indented portion of the formed plate which is to be bonded to the flat plate or the diameter of the communicating pipe in the area near the position at which it is inserted and fitted is set smaller than that of the indented portion of the formed plate, the communicating pipe does not come in contact with the indented portion of the formed plate. Thus, even with the communicating pipe inserted and fitted in the pipe connection hole of the flat plate, a large opening is formed between the formed plate and the communicating pipe, improving drainage to ensure that water is not readily collected there.

BRIEF DESCRIPTION OF THE DRAWINGS

The above and other features of the invention and the concomitant advantages will be better understood and appreciated by persons skilled in the field to which the invention pertains in view of the following description given in conjunction with the accompanying drawings which illustrate a preferred embodiment. In the drawings.

DETAILED DESCRIPTION OF THE PREFERRED EMBODIMENT

The following is an explanation of the preferred embodiment of the present invention in reference to the drawings.

Figure 1A:
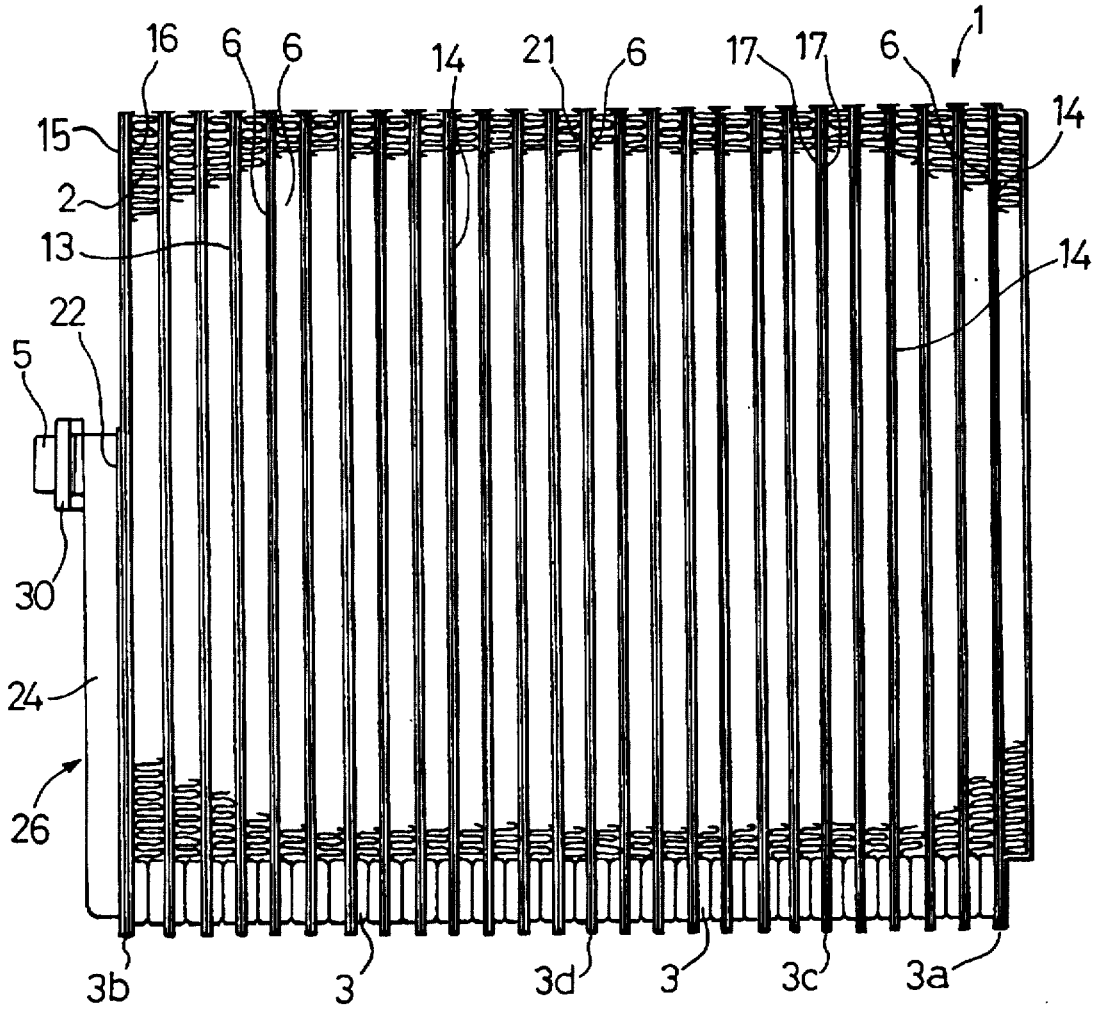
FIG. 1A is a front view illustrating the structure of the laminated heat exchanger according to the present invention and FIG. 1B is a bottom view illustrating the structure of the laminated heat exchanger according to the present invention.
Figure 1B:
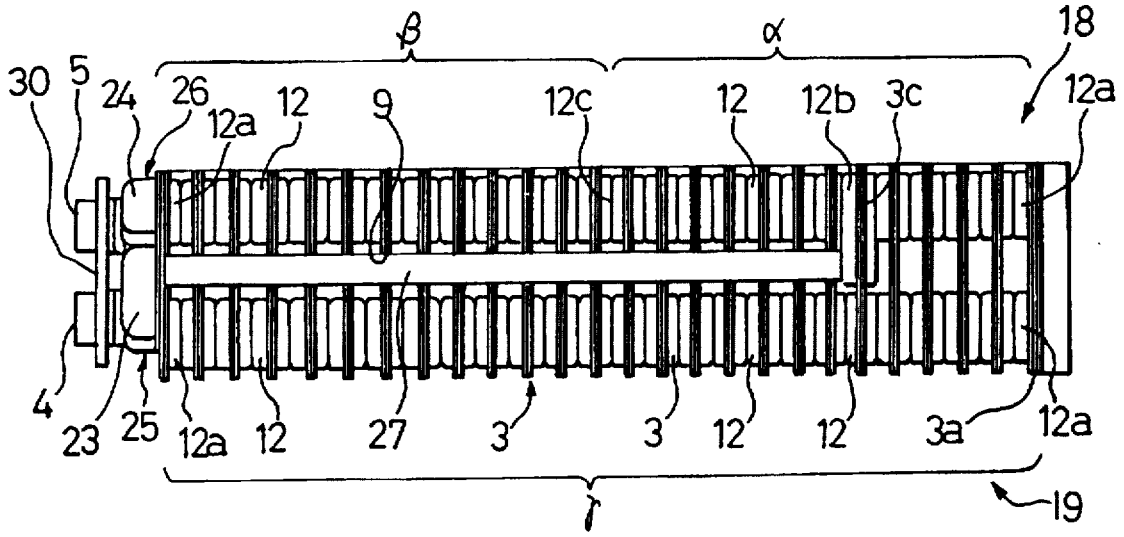
Figure 2:
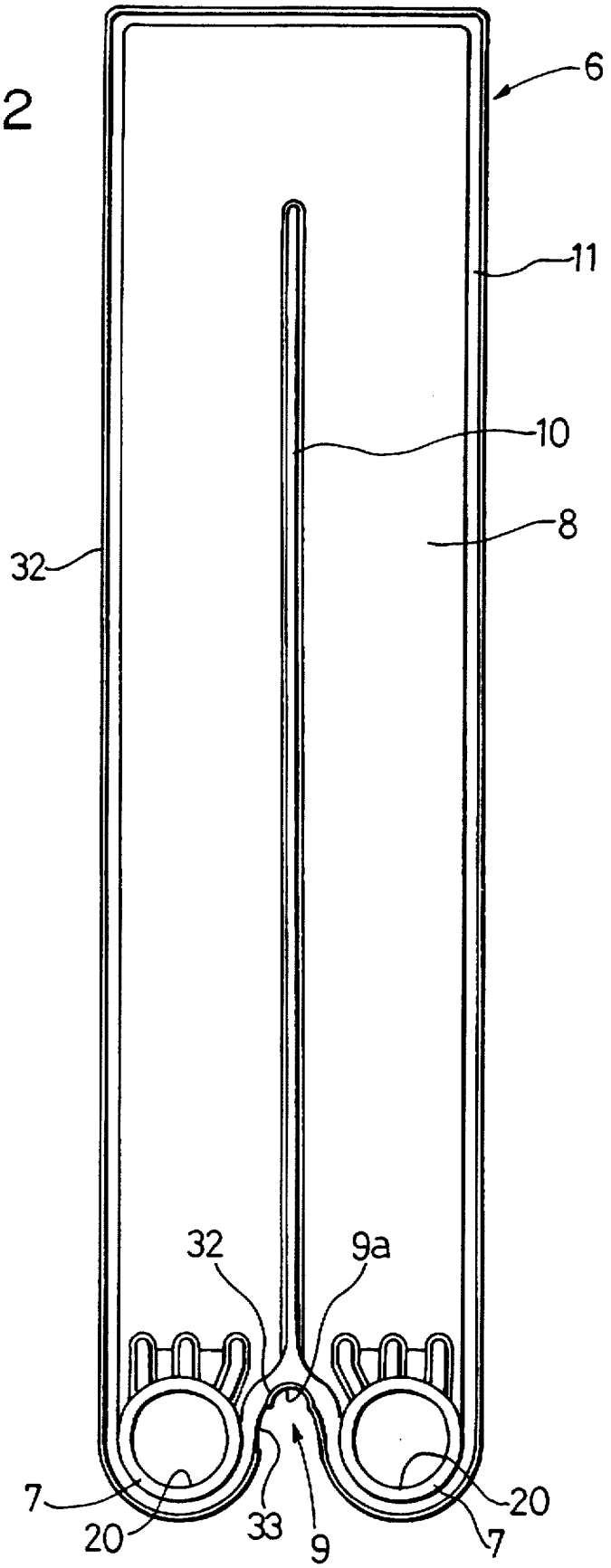
FIG. 2 is a front view illustrating the structure of a formed plate that constitutes the principal tube elements in the laminated heat exchanger above.

FIGS. 1A and 1B show an evaporator 1 employed in an air conditioning system for vehicles, for instance, as the laminated heat exchanger according to the present invention, which may adopt a four-pass system, for instance, with fins 2 and tube elements 3 laminated alternately over a plurality of levels to form a core main body and an inflow port 4 and an outflow port 5 for heat exchanging medium provided at one end in the direction of the lamination of the tube elements 3. The tube elements 3 are each constituted by bonding face-to-face two formed plates 6, one of which is shown in FIG. 2, except for tube elements 3*a* and 3*b* at the two end portions of the core main body in the direction of the lamination, a tube element 3*c* having an expanded tank which is to be detailed later and a tube element 3*d* located at approximately the center.

Figure 4:
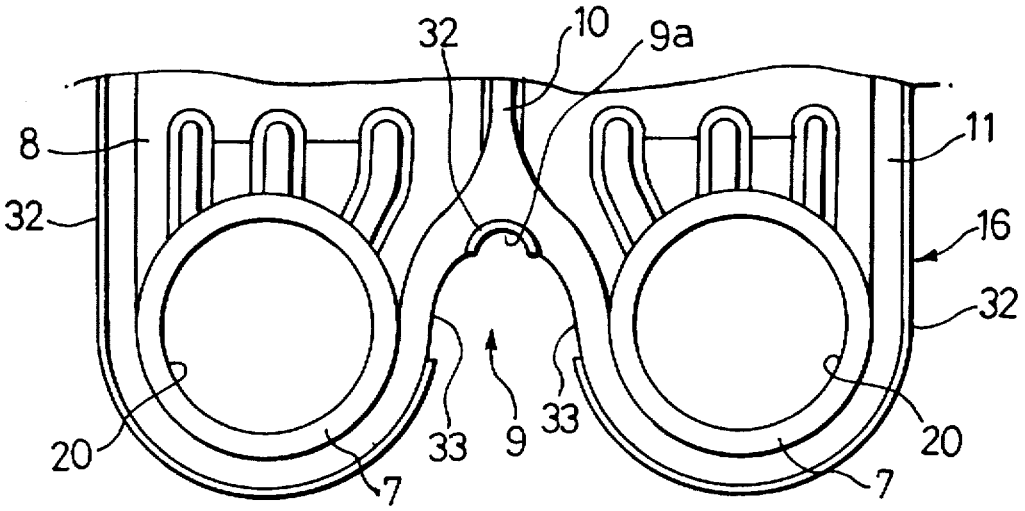
FIG. 4 is an enlargement illustrating, in essence, the structure of the formed plate bonded to the flat plate.

The formed plates 6 are each formed by press machining an aluminum alloy whose main constituent is aluminum with both surfaces thereof clad with a brazing material, having two bowl-shaped distended portions for tank formation 7 and 7 formed at one end, a distended portion for passage formation 8 formed continuous to them, an indented portion for pipe mounting 9 for mounting a communicating pipe 27, which is to be detailed later, formed between the distended portions for tank formation 7 and 7 and a partitioning wall 10 formed extending from the area between the two distended portions for tank formation 7 and 7 to the vicinity of the other end of the formed plate 6. In addition, a plurality of beads (not shown) are formed arrayed with a specific regularity at the distended portion for passage formation 8. It is to be noted that an arc-shaped indentation 9*a* may be formed at the indented portion for pipe mounting 9 toward the partitioning wall 10, as illustrated in FIGS. 2 and 4.

The distended portions for tank formation 7 and 7 distend to a larger degree than the distended portion for passage formation 8 and the partitioning wall 10 is formed on the same plane as a bonding margin 11 at the peripheral edges of the formed plate 6. Thus, when two formed plates 6 are bonded to each other at their peripheral edges, their partitioning walls 10 become bonded to each other so that a pair of tanks 12 and 12 are formed by the distended portions for tank formation 7 and 7 that face opposite each other and a U-shaped heat exchanging medium passage 13 connecting between the tanks 12 and 12 is formed by the distended portions for passage formation 8 which face opposite each other.

Figure 3A:
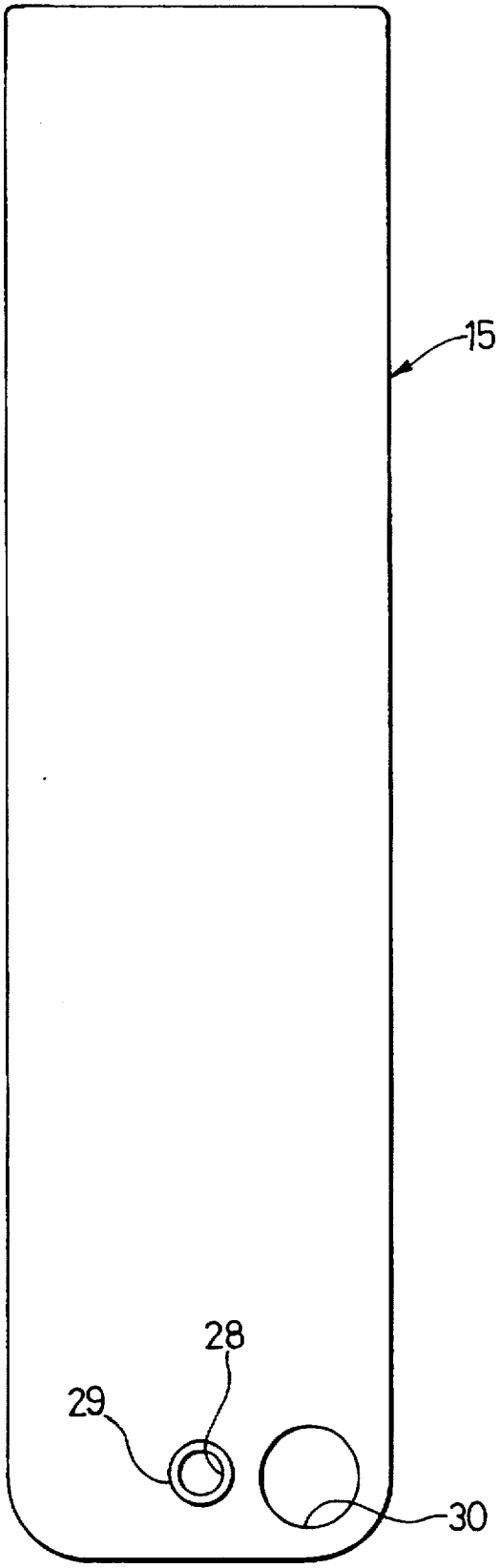
FIG. 3A is a front view illustrating the structure of a flat plate bonded to a distribution plate which is to form an intake port.
Figure 3B:
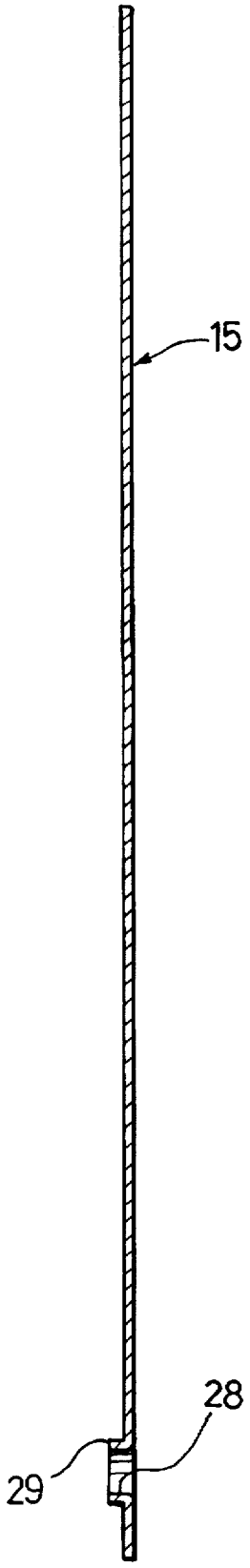
FIG. 3B is a cross section of the flat plate.

The tube element 3*a* at one side in the direction of the lamination is constituted by bonding a flat plate 14 with no indentations or projections to a formed plate 6 illustrated in FIG. 2, whereas the tube element 3*b* at the other side is constituted by bonding a flat plate 15 having a pipe connection hole 28 with a flange 29 (which is to be detailed later) formed at its circumferential edge and a communicating hole 30 as illustrated in FIG. 3 to a formed plate 16 illustrated in FIG. 4. Thus, tanks 12*a* and 12*a* whose capacity is approximately half of the capacity of the tanks 12 and 12 of the tube elements 3 are formed.

In addition, the tube element 3*c* is constituted by bonding face-to-face formed plates 17 and 17 in each of which one of the distended portions for tank formation is expanded so that it approaches the other distended portion for tank formation, and consequently, in the tube element 3*c* a tank 12 whose size is the same as that of the tanks 12 formed in the other tube elements 3, and a tank 12*b* which is expanded to fill the indented portion for pipe mounting 9, are formed.

Furthermore, in the evaporator 1, as illustrated in FIGS. 1A and 1B, adjacent tube elements are abutted at their tanks 12 and 12*a*, with two tank groups, i.e., a first tank group 18 and a second tank group 19, extending in the direction of the lamination (the direction perpendicular to the direction of the airflow) constituted by a series of abutted tanks 12. In the first tank group 18 that includes the expanded tank 12*b*, the individual tanks 12 are in communication with each other through communicating holes 20 (shown in FIG. 2) formed at the distended portions for tank formation 7 except at the tube element 3*d*, which is located at approximately the center in the direction of the lamination.

More specifically, the tube element 3*d* is constituted by bonding face-to-face the formed plate 6 shown in FIG. 2 and a formed plate 21 which is formed similar to the formed plate 6 but without a communicating hole formed at one of its distended portions for tank formation 7 to form a blind tank 12*c*. This tube element 3*d* divides the first tank group 18 into a first tank block α that includes the expanded tank 12*b* and a second tank block β that communicates with the outflow port 5. In addition, in the second tank group 19, all the tanks are in communication with each other through communicating holes 20 without partitioning to constitute a third tank block γ.

At one end in the direction of the lamination, a distribution plate 22 is bonded to the flat plate 15 as illustrated in FIGS. 1A and 1B. In this distribution plate 22, two bulging portions, i.e., a first bulging portion 23 and a second bulging portion 24, are formed distending side-by-side through press machining, with the inflow port 4 provided at one end of the first bulging portion 23 and the outflow port 5 provided at the end of the second bulging portion 24 at the same side. In addition, a brazing material is clad only on the internal surface of the distribution plate 22 in the direction of the lamination (the surface to be bonded to the flat plate 15). The flat plate 15, too, is clad with a brazing material only on its internal surface in the direction of the lamination. Thus, by bonding the distribution plate 22 to the flat plate 15, using the brazing material at the distribution plate 22, an inflow passage 25 communicating with the inflow port 4 and an outflow passage 26 communicating with the outflow port 5 are formed between the distribution plate 22 and the flat plate 15. The inflow passage 25 communicates with the communicating pipe 27 by connecting the communicating pipe 27, whose one end is connected to the expanded tank 12*b* at the pipe connection hole 28 of the flat plate 15 with the flange 29 formed at its circumferential edge at the other end using the brazing material at the communicating pipe 27 and the brazing material at the flat plate 15, whereas the outflow passage 26 communicates with the second tank block β via the communicating hole 30 of the flat plate 15. In addition, a coupling 31 for securing an expansion valve is bonded to the inflow port 4 and the outflow port 5.

Thus, the heat exchanging medium that has flowed in through the inflow port 4 enters the expanded tank 12*b* through the inflow passage 25 and the communicating pipe 27 to become dispersed over the entire first tank block α, and then flows via the heat exchanging medium passages of the tube elements corresponding to the first tank block α along the partitioning walls 10 (first pass). Then, it travels downward after making a U-turn above the partitioning walls 10 (second pass) and reaches the tank group at the opposite side (the third tank block γ). After this, it moves horizontally to the remaining tube elements constituting the third tank block γ to flow through the heat exchanging medium passages 13 of the remaining tube elements along their partitioning walls 10 (the third pass). Next, it makes a U-turn above the partitioning walls 10 before traveling downward (the fourth pass), is led to the tanks constituting the second tank block β, and then it travels through the outflow passage 26 to flow out through the outflow port 5. Thus, the heat of the heat exchanging medium is conducted to the fins 2 during the process in which it flows through the heat exchanging medium passages 13 corresponding to the first through fourth passes so that heat exchange is performed with the air passing between the fins 2 and 2.

It is to be noted that while the formed plates 6 (also the formed plates 17 and 21) are each provided with a flange 32 which is constituted by bending edge portions of the bonding margin 11 at the circumferential edge of the distended portion for passage formation 8 and the bonding margin 11 of the distended portions for tank formation 7 toward the non-bonding side, as illustrated in FIG. 2, in order to increase the strength of the formed plate 6, a notched portion 33 is formed at the circumferential edge of the indented portion for pipe mounting 9 between the distended portions for tank formation 7 and 7 by notching in an arc shape the flange 32 and the bonding margin 11 continuous to the flange 32 except at the area where the arc-shaped indentation 9*a* is formed at one side relative to the center on the inside of the indented portion for pipe mounting 9. In other words, at the indented portion for pipe mounting 9, the diameter at one side with the center of its inside, is expanded.

Figure 5:
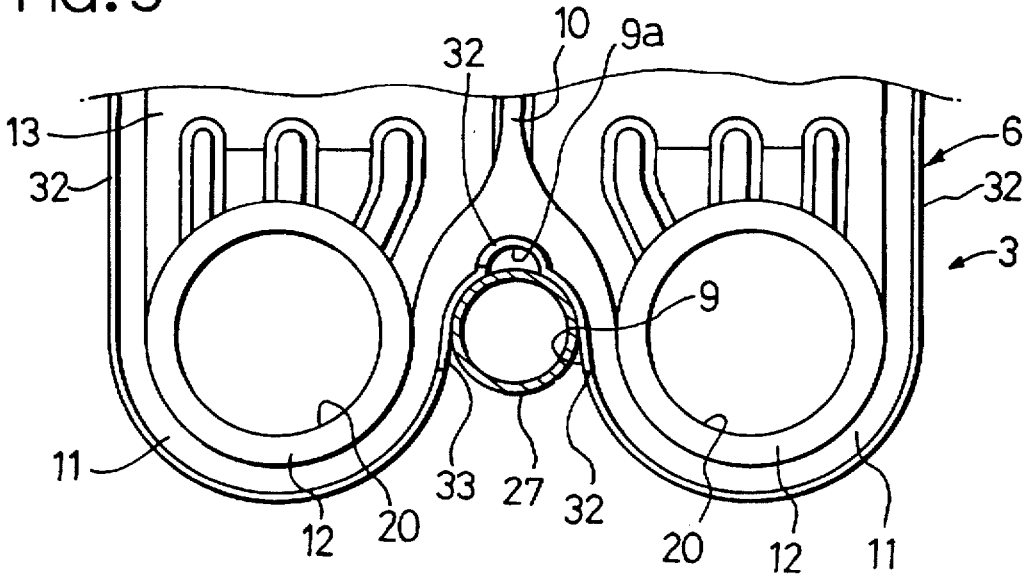
FIG. 5 is an enlargement illustrating, in essence, a communicating pipe mounted at an indented portion achieved by bonding face-to-face two formed plates.
Figure 6:
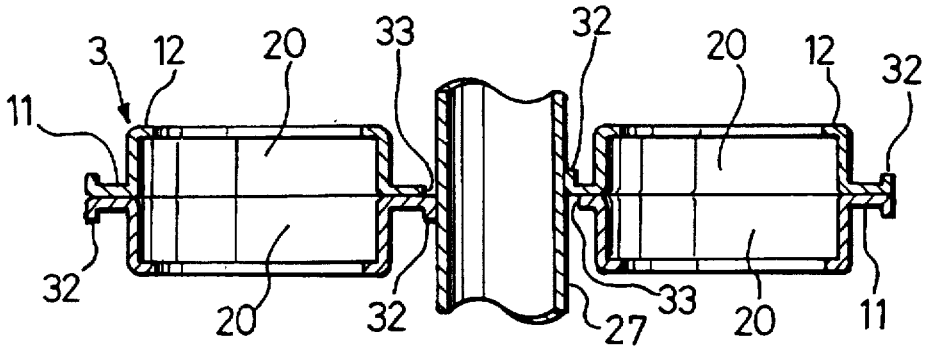
FIG. 6 is a cross section illustrating the communicating pipe mounted at the indented portion achieved by bonding face-to-face the two formed plates.

Thus, as illustrated in FIGS. 5 and 6, since the flange and the bonding margin are eliminated at the indented portion for pipe mounting 9 at the distended portions for tank formation 7 in the formed plate 6 by the notched portion 33, when two formed plates 6 and 6 are bonded to each other, a size difference of approximately 0.6 mm over which the flange 32 and the like of the other formed plate 6 is visible at each formed plate 6 is alternately formed at the indented portions 9. Thus, when the communicating pipe 27 is fitted at the indented portions for pipe mounting 9, the tube element 3 comes in contact with the communicating pipe 27 at the flange 32 at one of the indented portions for pipe mounting 9 in the formed plate 6 but does not come in contact with the communicating pipe 27 at the other indented portion 9 due to the size difference.

Figure 7:
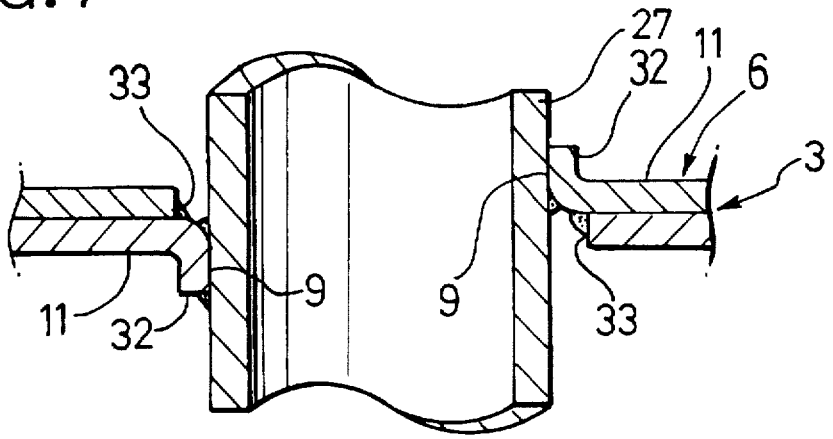
FIG. 7 is an enlargement illustrating, in essence, the communicating pipe brazed at the indented portion of the tube element constituted by bonding the formed plates above.

Consequently, when the assembled body of the evaporator 1 is brazed in a furnace after mounting the communicating pipe 27 at the indented portion for pipe mounting 9, a large opening is formed in alternate directions in the space formed by the formed plates 6 and 6 and the communicating pipe 27 to the tube element 3, as illustrated in FIG. 7, since portions of the flange and the bonding margin are removed. This improves drainage and even if water enters the gap, it is less likely to collect there.

In contrast, the formed plate 16 constituting the tube element 3*b* located at one end of the evaporator illustrated in FIG. 4 has a structure that is partially different at its notched portion 33 from the formed plate 6. Namely, notched portions 33 and 33 are formed by notching in an almost arc shape the flange 32 and the bonding margin 11 continuous to the flange 32 except at the area where the arc shaped indentation 9*a* is formed at the two sides relative to the center on the inside of the indented portion for pipe mounting 9.

Figure 8:
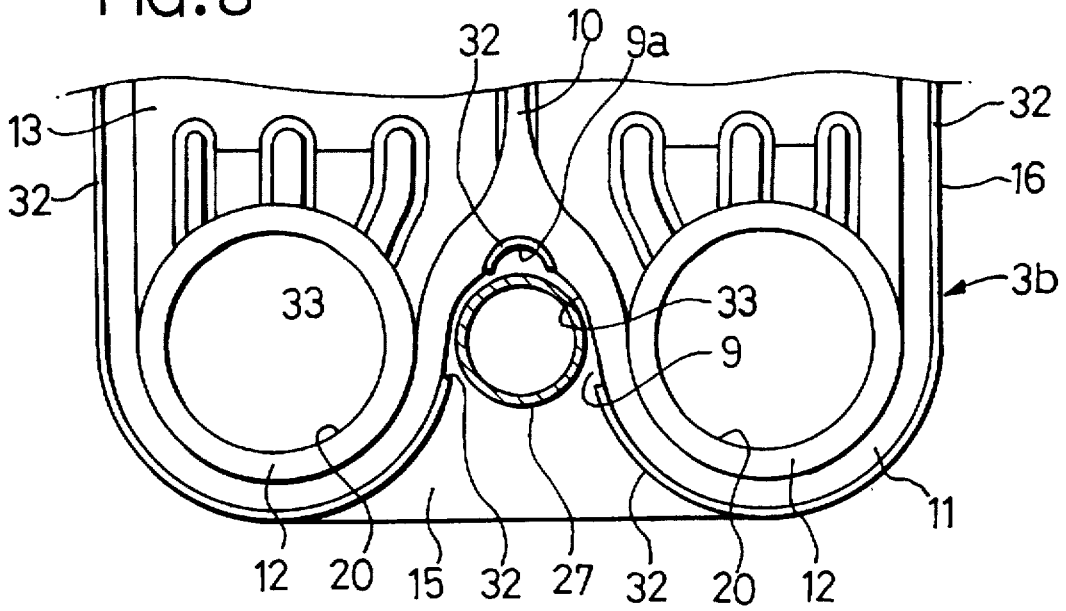
FIG. 8 is an enlargement illustrating, in essence, the communicating pipe inserted and fitted in a hole of the flat plate for forming inflow passage and an outflow passage bonded to an formed plate.
Figure 9:
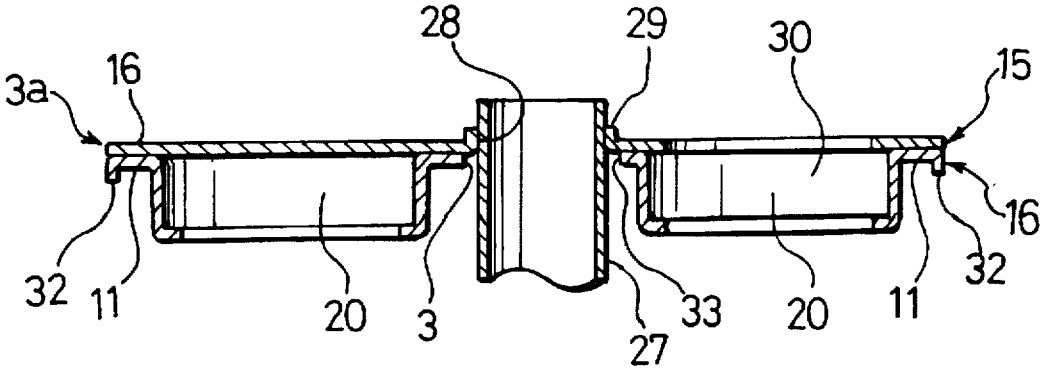
FIG. 9 is a cross section illustrating the communicating pipe inserted and fitted in the hole of the flat plate above bonded to the formed plate.

Thus, as illustrated in FIGS. 8 and 9, since the flange and the bonding margin are removed at the indented portion for pipe mounting 9 between the distended portions for tank formation 7 by the notched portions 33 in the formed plate 16, when the communicating pipe 27 is inserted and fitted in the pipe connection hole 28 of the tube element 3*b*, the communicating pipe 27 comes in contact with the internal surface of the flange 29 at the flat plate 15 but does not come in contact with the tube element 3*b* toward the formed plate 16 side.

Figure 10:
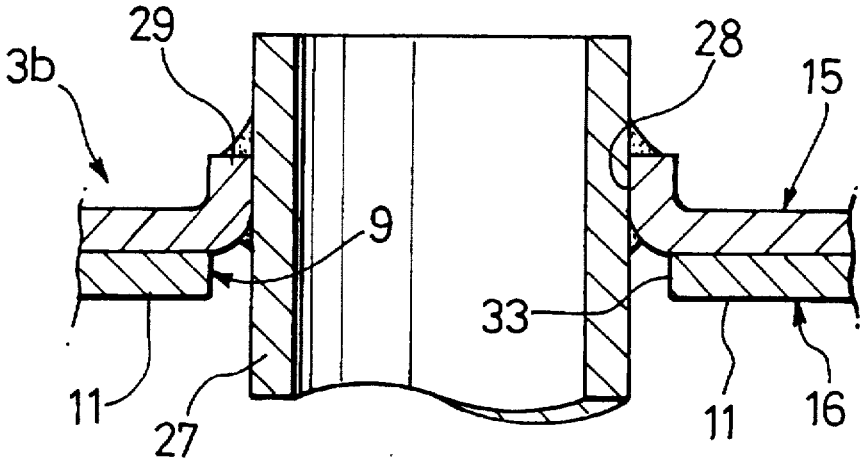
FIG. 10 is a cross section illustrating the communicating pipe brazed at the indented portion of the tube element constituted by bonding the flat plate above and the formed plate above.

As a result, as illustrated in FIG. 10, a large opening is provided oriented toward the inside in the direction of the lamination of the evaporator in the space formed by the flange 29 of the flat plate 15, the formed plate 16 and the communicating pipe 27 since portions of the flange and the connecting margin are not present at the formed plate 16, thereby improving the drainage, which prevents water that has entered the gap from becoming collected in the gap readily.

Figure 11:
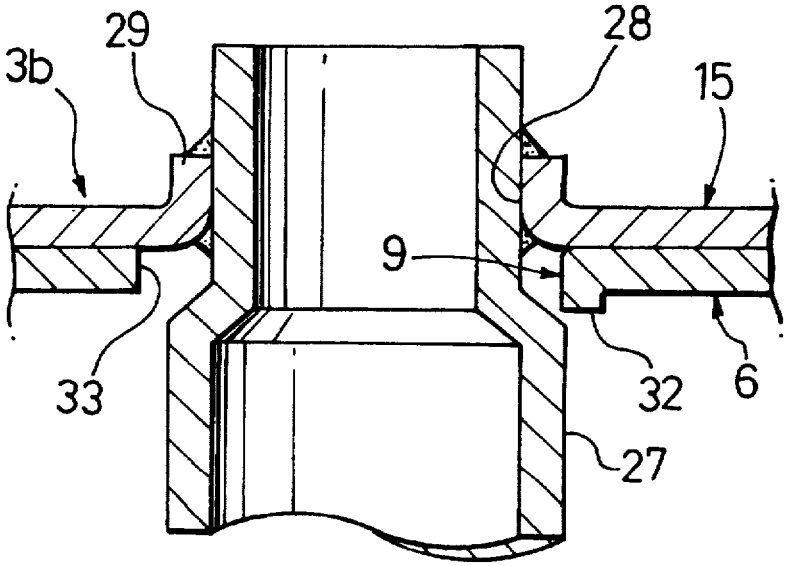
FIG. 11 is a cross section illustrating the communicating pipe, whose diameter at the area near the position of the insertion is reduced, inserted and fitted at the tube element constituted by bonding the formed plate shown in FIG. 2 and the flat plate shown in FIG. 3.
Figure 12:
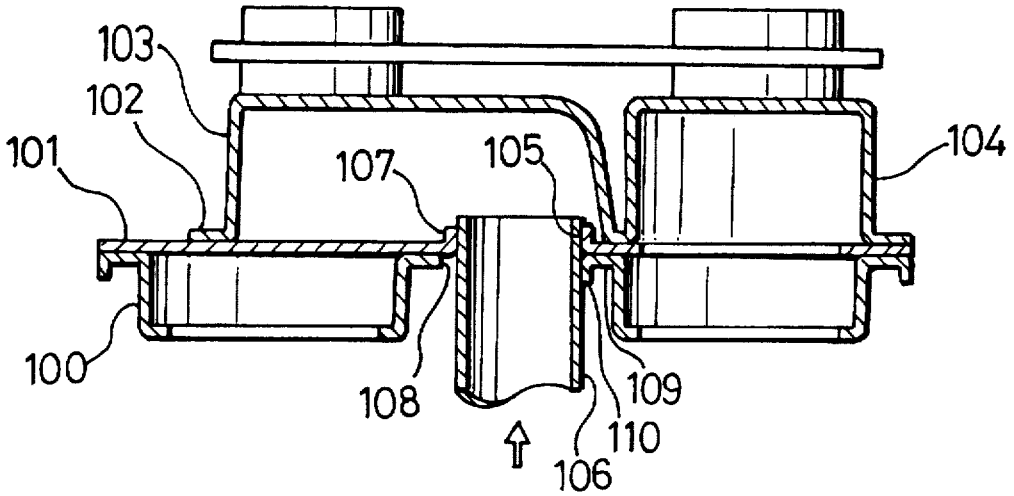
FIG. 12 PRIOR ART
FIG. 12 is a cross section illustrating a prior art communicating pipe, having a consistent diameter, inserted and fitted at a tube element constituted by bonding the formed plate shown in FIG. 2 and the flat plate shown in FIG. 3.
Figure 13:
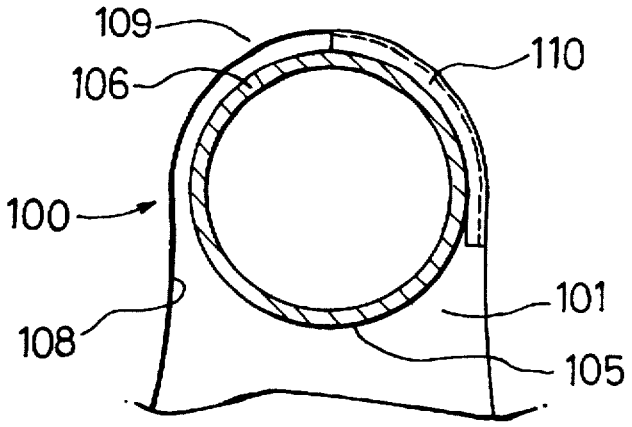
FIG. 13 PRIOR ART
FIG. 13 is an enlargement illustrating, in essence, the state shown in FIG. 12 viewed from the direction indicated by the arrow in FIG. 12.
Figure 14:
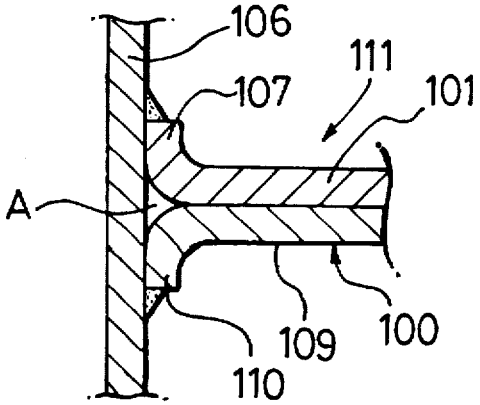
FIG. 14 PRIOR ART
FIG. 14 is an enlargement illustrating, in essence, the state in which a gap is formed, bounded by the formed plate, the flat plate and the communicating pipe through defective brazing in the example of the prior art above.

The communicating pipe 27 may be prevented from coming in contact with the indented portion for pipe mounting 9 of the formed plate bonded to the flat plate 15 by other means than forming the notched portions 33 at the formed plate at the two sides relative to the center on the inside as described above. Namely, as illustrated in FIG. 11, while the formed plate 6 illustrated in FIG. 2 is bonded to the flat plate 15, the diameter of the communicating pipe 27 in an area near one end may be reduced with the diameter of the pipe connection hole 28 at the flat plate 15 also reduced in correspondence to the reduced diameter of the communicating pipe, instead.

In this case, even with the flange 32 remaining at one side of the formed plate bonded to the flat plate 15 relative to the center on the inside of the indented portion 9, a sealed space between the flange 32 and the communicating pipe 27 is eliminated to a degree corresponding to the reduction in the diameter of the communicating pipe 27 after the evaporator 1 is brazed, thereby improving the drainage and preventing water that has entered the space from collecting readily. In addition, since all the notched portions 33 of the formed plates can be formed at one side relative to the center on the inside, the manufacturing process for manufacturing the formed plates is simplified.

As has been explained, according to the present invention, since the portion of the communicating pipe near one end is not in contact with the indented portion of the formed plate which is bonded to the flat plate toward the outflow port, a large opening is formed between the formed plate and the communicating pipe to make it less likely that water will collect in the space formed by the flat plate for constituting the inflow passage and the outflow passage, the formed plate and the communicating pipe. Thus, the communicating pipe and the tube elements are prevented from being damaged by the water repeating the process of freezing and melting. In addition, since the drainage is improved and water does not collect in the space readily, corrosion of the communicating pipe and the tube elements is prevented.

What is claimed is:

1. A laminated heat exchanger comprising:

first tube elements, each of which is constituted by bonding face-to-face a pair of formed plates and has a pair of tanks provided at one end in a lengthwise direction thereof, a heat exchanging medium passage communicating between said pair of tanks and an indented portion formed between said pair of tanks, each of said tanks having a pair of communication holes in a lamination direction of said laminated heat exchanger;

second tube elements provided at both sides in said lamination direction of said laminated heat exchanger, each of which is constituted by bonding face-to-face a formed plate and a flat plate and has a pair of tanks provided at one end in a lengthwise direction thereof, a heat exchanging medium passage communicating between said pair of tanks and an indented portion formed between said pair of tanks, each of said tanks having a communication hole at one end in said lamination direction and opposite said flat plate, said flat plate of one of said second tube elements being provided with a pipe connection hole at an approximate center of one end thereof in said lengthwise direction, said pipe connection hole being open at said indented portion;

a third tube element constituted by bonding face-to-face a pair of formed plates and having a pair of tanks provided at one end in a lengthwise direction thereof and a heat exchanging medium passage communicating between said pair of tanks, said tanks having communication holes at both sides in said lamination direction, one of said pair of tanks being an expanded tank extending out to an area near the other of said pair of tanks;

a fourth tube element constituted by bonding face-to-face a pair of formed plates and having a pair of tanks provided at one end in a lengthwise direction thereof and a heat exchanging medium passage communicating between said pair of tanks, one of said pair of tanks having communication holes at both sides in said lamination direction, the other of said pair of tanks having a communication hole at one side in said lamination direction and no communication hole in the other side in said lamination direction so as to constitute a blind tank;

fins alternately laminated with said first tube elements, said second tube elements, said third tube element and said fourth tube element;

a distribution plate provided on an outside of said one of said second tube elements, said distribution plate being provided with an inflow passage communicated with an inflow port for heat exchanging medium and an outflow passage communicated with an outflow port for heat exchanging medium;

a communicating pipe communicating between said expanded tank and said inflow passage, said communicating pipe being located in said indented portions and positioned between said third tube element with said expanded tank and one of said second tube elements, one end of said communicating pipe being inserted into said pipe connection hole;

wherein said pairs of tanks of said first tube elements, said second tube elements, said third tube element and said fourth tube element together form a first tank group and a second tank group, said first tank group being divided into first and second tank blocks by said blind tank, said second tank group being in communication throughout to constitute a third tank block, said expanded tank of said third tube element being located in one of said first and second tank blocks and remote from said flat plate of said one of said second tube elements; and wherein said one end of said communicating pipe inserted into said pipe connection hole is provided with a small diameter portion whose diameter is smaller than a width of said indented portion of said formed plate of said one of said second tube elements, said communicating pipe being detached, at said small diameter portion thereof, from said indented portion of said one of said second tube elements.

2. A laminated heat exchanger according to claim 1, wherein said formed plate of said one of said second tube elements is provided with a bonding margin at a circumferential edge thereof and a flange bent from said bonding margin toward a non-bonding side, and a notched portion is formed by notching a contact portion of said flange in contact with said communicating pipe at said indented portion, said communicating pipe being detached from said indented portion in said notched portion.

3. A laminated heat exchanger according to claim 1, wherein an arc-shaped portion notched in an arc shape is formed at a central area of said indented portion of each of said first tube elements, said one of said second tube elements and said fourth tube element.

4. A laminated heat exchanger according to claim 1, wherein each of said formed plates of said first tube elements, said second tube elements and said fourth tube element is provided with a notched portion formed by notching over a specific range one side of said flange provided at both sides of said indented portion in contact with said communicating pipe.

5. A laminated heat exchanger according to claim 3, wherein each of said formed plates of said first tube elements, said second tube elements and said fourth tube element is provided with a notched portion formed by notching over a specific range one side of said flange provided at both sides of said indented portion in contact with said communicating pipe.

6. A laminated heat exchanger comprising:

first tube elements, each of which is constituted by bonding face-to-face a pair of formed plates and has a pair of tanks provided at one end in a lengthwise direction thereof, a heat exchanging medium passage communicating between said pair of tanks and an indented portion formed between said pair of tanks, each of said tanks having a pair of communication holes in a lamination direction of said laminated heat exchanger;

second tube elements provided at both sides in said lamination direction of said laminated heat exchanger, each of which is constituted by bonding face-to-face a formed plate and a flat plate and has a pair of tanks provided at one end in a lengthwise direction thereof, a heat exchanging medium passage communicating between said pair of tanks and an indented portion formed between said pair of tanks, each of said tanks having a communication hole at one end in said lamination direction and opposite said flat plate, said flat plate of one of said second tube elements being provided with a pipe connection hole at an approximate center of one end thereof in said lengthwise direction, said pipe connection hole being open at said indented portion, wherein said flat plate of said one of said second tube elements has a cylindrical flange extending out from a circumferential edge of said pipe connection hole in an insertion direction of said communicating pipe;

a third tube element constituted by bonding face-to-face a pair of formed plates and having a pair of tanks provided at one end in a lengthwise direction thereof and a heat exchanging medium passage communicating between said pair of tanks, said tanks having communication holes at both sides in said lamination direction, one of said pair of tanks being an expanded tank extending out to an area near the other of said pair of tanks;

a fourth tube element constituted by bonding face-to-face a pair of formed plates and having a pair of tanks provided at one end in a lengthwise direction thereof and a heat exchanging medium passage communicating between said pair of tanks, one of said pair of tanks having communication holes at both sides in said lamination direction, the other of said pair of tanks having a communication hole at one side in said lamination direction and no communication hole in the other side in said lamination direction so as to constitute a blind tank;

fins alternately laminated with said first tube elements, said second tube elements, said third tube element and said fourth tube element;

a distribution plate provided on an outside of said one of said second tube elements, said distribution plate being provided with an inflow passage communicated with an inflow port for heat exchanging medium and an outflow passage communicated with an outflow port for heat exchanging medium;

a communicating pipe communicating between said expanded tank and said inflow passage, said communicating pipe being located in said indented portions and positioned between said third tube element with said expanded tank and one of said second tube elements, one end of said communicating pipe being inserted into said pipe connection hole;

wherein said pairs of tanks of said first tube elements, said second tube elements, said third tube element and said fourth tube element together form a first tank group and a second tank group, said first tank group being divided into first and second tank blocks by said blind tank, said second tank group being in communication throughout to constitute a third tank block, said expanded tank of said third tube element being located in one of said first and second tank blocks and remote from said flat plate of said one of said second tube elements; and wherein said indented portion of said formed plate of said one of said second tube elements is detached from said communicating pipe.

7. A laminated heat exchanger comprising:

first tube elements, each of which is constituted by bonding face-to-face a pair of formed plates and has a pair of tanks provided at one end in a lengthwise direction thereof, a heat exchanging medium passage communicating between said pair of tanks and an indented portion formed between said pair of tanks, each of said tanks having a pair of communication holes in a lamination direction of said laminated heat exchanger;

second tube elements provided at both sides in said lamination direction of said laminated heat exchanger, each of which is constituted by bonding face-to-face a formed plate and a flat plate and has a pair of tanks provided at one end in a lengthwise direction thereof, a heat exchanging medium passage communicating between said pair of tanks and an indented portion formed between said pair of tanks, each of said tanks having a communication hole at one end in said lamination direction and opposite said flat plate, said flat plate of one of said second tube elements being provided with a pipe connection hole at an approximate center of one end thereof in said lengthwise direction, said pipe connection hole being open at said indented portion, wherein said flat plate of said one of said second tube elements has a cylindrical flange extending out from a circumferential edge of said pipe connection hole in an insertion direction of said communicating pipe;

a third tube element constituted by bonding face-to-face a pair of formed plates and having a pair of tanks provided at one end in a lengthwise direction thereof and a heat exchanging medium passage communicating between said pair of tanks, said tanks having communication holes at both sides in said lamination direction, one of said pair of tanks being an expanded tank extending out to an area near the other of said pair of tanks;

a fourth tube element constituted by bonding face-to-face a pair of formed plates and having a pair of tanks provided at one end in a lengthwise direction thereof and a heat exchanging medium passage communicating between said pair of tanks, one of said pair of tanks having communication holes at both sides in said lamination direction, the other of said pair of tanks having a communication hole at one side in said lamination direction and no communication hole in the other side in said lamination direction so as to constitute a blind tank;

fins alternately laminated with said first tube elements, said second tube elements, said third tube element and said fourth tube element;

a distribution plate provided on an outside of said one of said second tube elements, said distribution plate being provided with an inflow passage communicated with an inflow port for heat exchanging medium and an outflow passage communicated with an outflow port for heat exchanging medium;

a communicating pipe communicating between said expanded tank and said inflow passage, said communicating pipe being located in said indented portions and positioned between said third tube element with said expanded tank and one of said second tube elements, one end of said communicating pipe being inserted into said pipe connection hole;

wherein said pairs of tanks of said first tube elements, said second tube elements, said third tube element and said fourth tube element together form a first tank group and a second tank group, said first tank group being divided into first and second tank blocks by said blind tank, said second tank group being in communication throughout to constitute a third tank block, said expanded tank of said third tube element being located in one of said first and second tank blocks and remote from said flat plate of said one of said second tube elements; and wherein said formed plate of said one of said second tube elements is provided with a bonding margin at a circumferential edge thereof and a flange bent from said bonding margin toward a non-bonding side, and a notched portion is formed by notching a contact portion of said flange in contact with said communicating pipe at said indented portion, said communicating pipe being detached from said indented portion in said notched portion.

8. A laminated heat exchanger according to claim 1, wherein said flat plate of said one of said second tube elements has a cylindrical flange extending out from a circumferential edge of said pipe connection hole in an insertion direction of said communicating pipe.

9. A laminated heat exchanger according to claim 2, wherein said flat plate of said one of said second tube elements has a cylindrical flange extending out from a circumferential edge of said pipe connection hole in an insertion direction of said communicating pipe.

10. A laminated heat exchanger according to claim 3, wherein said flat plate of said one of said second tube elements has a cylindrical flange extending out from a circumferential edge of said pipe connection hole in an insertion direction of said communicating pipe.

11. A laminated heat exchanger according to claim 4, wherein said flat plate of said one of said second tube elements has a cylindrical flange extending out from a circumferential edge of said pipe connection hole in an insertion direction of said communicating pipe.

12. A laminated heat exchanger according to claim 5, wherein said flat plate of said one of said second tube elements has a cylindrical flange extending out from a circumferential edge of said pipe connection hole in an insertion direction of said communicating pipe.

* * * * *